US006327449B1

(12) United States Patent
Matsuzaki

(10) Patent No.: US 6,327,449 B1
(45) Date of Patent: Dec. 4, 2001

(54) ELECTROPHOTOGRAPHIC APPARATUS FOR FORMING COLOR IMAGE

(75) Inventor: Shigeru Matsuzaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/329,315

(22) Filed: Jun. 10, 1999

(30) Foreign Application Priority Data

Jun. 16, 1998 (JP) ..... 10-183250

(51) Int. Cl.[7] ..... G03G 15/00
(52) U.S. Cl. ..... 399/227; 399/228
(58) Field of Search ..... 399/119, 73, 94, 399/223, 226–229

(56) References Cited

U.S. PATENT DOCUMENTS 5,600,431 * 2/1997 Takeda et al. ..... 399/226
5,799,228 * 8/1998 Iwata et al. ..... 399/94
6,122,470 * 9/2000 Kimura ..... 399/227

FOREIGN PATENT DOCUMENTS 9-6206 * 1/1997 (JP) .
9-114179 * 5/1997 (JP) .
10-177284 * 6/1998 (JP) .

* cited by examiner

*Primary Examiner*—Quana M. Grainger
(74) *Attorney, Agent, or Firm*—Fitzpatrick, Cella, Harper & Scinto

(57) ABSTRACT

An image forming apparatus has a plurality of shiftable developing devices that contain toner. The image forming apparatus includes a fixing apparatus for fixing a toner image onto a recording material by heat, and the plurality of developing devices are disposed above the fixing apparatus. When a predetermined time period has elapsed after a temperature of the fixing apparatus reaches a predetermined temperature, the plurality of developing devices are shifted away from the fixing apparatus. With this arrangement, the toner contained in the developing device is prevented from being softened, melted and solidified due to the heat from the fixing apparatus, thereby effecting image formation stably.

18 Claims, 6 Drawing Sheets

ELECTROPHOTOGRAPHIC APPARATUS FOR FORMING COLOR IMAGE

BACKGROUND OF THE INVENTION

1. Field of the Invention

The present invention relates to an image forming apparatus such as a copying machine, a printer and the like, and more particularly, it relates to an image forming apparatus having a shiftable developing means.

2. Related Background Art

In the past, a color image forming apparatus in which a plurality of different color toner images are successively transferred onto a single transfer material in a superimposed fashion by using a plurality of developing devices containing different color toners and the color images are fixed to the transfer material to obtain a full-color image has widely been used. FIG. 6 shows a conventional color image forming apparatus. Now, such a color image forming apparatus will be described.

FIG. 6 is a view showing an entire construction of a color laser printer as an example of a color image forming apparatus.

An image forming portion of the color laser printer is constituted by a photosensitive drum (image bearing member) 45 rotated at a constant speed, a fixed black developing device 49B, and three rotatable color developing devices (yellow developing device 48Y, magenta developing device 48M and cyan developing device 48C).

Below the image forming portion, there is disposed an intermediate transfer member 43 for holding the developed color toner images in a superimposed fashion and for transferring the color toner images onto a transfer material 42 fed from a feeding portion.

The transfer material 42 to which the color images were transferred is sent to a fixing portion 52, where the color images are fixed to the transfer material 42. Thereafter, the transfer material is discharged onto a discharge portion 61 provided on an upper surface of the printer via pairs of discharge rollers 58, 59, 60.

The photosensitive drum 45 is constituted by coating an organic photo-conductor layer on an outer surface of an aluminium cylinder having a diameter of about 62 mm, and a cleaner blade 46 and a primary charging means 47 are disposed around the photosensitive drum.

The photosensitive drum 45 is rotated in a counter clockwise direction in FIG. 6 in synchronous with an image forming operation by transmitting a driving force of a drive motor (not shown) provided at a rear side in FIG. 6 to the photosensitive drum.

Exposure to the photosensitive drum 45 is effected by a scanner portion 57. That is to say, when an image signal is sent to a laser diode, the laser diode illuminates light onto a polygon mirror at a timing corresponding to the image signal. The polygon mirror is rotated at a high speed by a scanner motor so that the light reflected from the polygon mirror can selectively expose the surface of the photosensitive drum 45 through a focusing lens and a reflection mirror, thereby forming an electrostatic image on the photosensitive drum 45.

The electrostatic image is visualized by three rotatable developing devices 48Y, 48M, 48C and a black developing device 49B which perform yellow color development, magenta color development, cyan color development and black color development.

The black developing device 49B is fixed at a developing position, except that this developing device is mounted to a main body of the printer. The black developing device serves to form a visualized image with black toner.

A toner containing capacity of the black developing device 49B is selected to be greater than toner containing capacities of the other developing devices 48Y, 48M, 48C by about two times or more to permit printing of 15,000 sheets (A4 size sheet, printing percentage=5%) in consideration of kinds of documents handled by an operator, image patterns and the amount of toner consumed.

By increasing the toner containing capacity of the black developing device in this way, frequency for exchanging the black developing device is reduced, and running cost for each print can also be reduced.

As shown in FIG. 6, the black developing device is disposed between the laser scanner and the three rotatable developing devices 48Y, 48M, 48C. With this arrangement, the toners leaking when the developing devices 48Y, 48M, 48C are rotated are prevented from scattering onto the optical parts such as the laser scanner. In this manner, the toner is prevented from adhering to the polygon mirror, lens and mirror to worsen electrostatic image formation, thereby obtaining a sharp output image.

Each of the three rotatable developing devices 48Y, 48M, 48C contains the toner for permitting printing of 6,000 sheets (A4 size sheet, printing percentage=5%). The three rotatable developing devices are held detachably attachable to a developing rotary 51 rotated around a shaft 50.

In the image formation, the developing devices are rotatingly shifted around the shaft 50 in the condition that they are held on the developing rotary 51 so that the pre-selected developing device is stopped at a position opposed to the photosensitive drum 45. In this case, the visualized image corresponding to the electrostatic image on the photosensitive drum 45 is formed.

In the color image formation, whenever the intermediate transfer member 43 is rotated by one revolution, the developing rotary 51 is rotated so that developing processes of the yellow developing device 48Y, magenta developing device 48M, cyan developing device 48C and black developing device 49B are successively effected in order.

For example, when the rotatable yellow developing device 48Y is positioned and stopped at the position opposed to the photosensitive drum 45, the rotatable yellow developing device 48Y effects development on the photosensitive drum 45 with yellow toner to form an yellow toner image. Similarly, regarding the magenta developing device 48M and the cyan developing device 48C, the color toner development is effected in the same mechanism. Application of bias and transmission of driving force to developing rollers of the rotatable developing devices 48Y, 48M, 48C are performed when each of the developing devices is rotatingly shifted to the developing position.

The intermediate transfer member 43 serves to receive the toner images on the photosensitive drum 45 visualized by the developing devices during the color image formation by four times (yellow, magenta, cyan and black color images) in a superimposed fashion. The intermediate transfer member 43 is rotated in a clockwise direction in FIG. 6 in synchronous with the outer peripheral speed of the photosensitive drum 45.

The intermediate transfer member 43 to which the toner images were transferred in the superimposed fashion cooperates with a transfer roller 44 (to which voltage is applied) to pinch and convey the transfer material 42 therebetween, with the result that the color toner images on the intermediate transfer member 42 are collectively transferred onto the transfer material 42.

In this example, the intermediate transfer member 43 is constituted by coating an elastic layer made of middle resistance sponge or middle resistance rubber on an aluminium cylinder having a diameter of 186 mm.

A cleaning means serves to remove residual toner remaining on the photosensitive drum 45 after the toner image on the photosensitive drum 45 visualized by the developing means were transferred to the intermediate transfer member 43.

While the four color toner images are being formed on the intermediate transfer member 43, i.e., while the intermediate transfer member 43 is being rotated by several revolutions, as shown by the solid line in FIG. 6, the transfer roller 44 is located at a lower position so that the roller is spaced apart from the intermediate transfer member 43 not to distort the images.

After the four color toner images were formed on the intermediate transfer member 43, as shown by the two dots and chain line in FIG. 6, the transfer roller 44 is shifted to an upper position where the roller is urged against the intermediate transfer member 43 with predetermined pressure, at a timing corresponding to the transferring of the color images onto the transfer material 42. At the same time, bias is applied to the transfer roller 44, thereby transferring the toner images on the intermediate transfer member 43 onto the transfer material 42.

The transfer material 42 pinched between the intermediate transfer member 43 and the transfer roller 44 is subjected to the transferring process, and, at the same time, the transfer material is conveyed to the left in FIG. 6 at a predetermined speed toward the fixing device.

The fixing portion 52 serves to fix the toner images formed in the previous process. As shown in FIG. 6, the fixing portion 52 comprises a fixing roller 53 for applying heat to the transfer material 42, and a pressure roller 54 for urging the transfer material 42 against the fixing roller 53. The rollers are hollow rollers having heaters 55, 56 therein. By rotating the rollers, the transfer material 42 is conveyed. That is to say, the transfer material 42 bearing the toner images is conveyed by the fixing roller 53 and the pressure roller 54; meanwhile, by applying heat and pressure to the transfer material, the toner is fixed to the transfer material 42.

The toner images are melted and mixed by the fixing device 52 to form a full-color image fixed to the transfer material. Thereafter, the transfer material is discharged out of the printer.

The image forming apparatus having the above-mentioned construction has the following problems. Briefly explaining, since the charging device 47, image signal supplying position, rotary developing apparatus 50 and cleaner 46 which are disposed around the photosensitive drum 45 cannot be changed in their order or sequence, if the apparatus tries to be made more compact, the developing apparatus will be arranged in the vicinity of the fixing apparatus. Particularly, in an apparatus using a transfer drum (intermediate transfer member), the rotary developing apparatus may be disposed above the fixing apparatus.

There has widely been used a fixing apparatus comprising a fixing roller in which a surface temperature thereof is maintained to about 140° C. to 180° C. and a pressure roller urged against the fixing roller and wherein a transfer material bearing non-fixed toner images is passed through a fixing nip portion between these rollers. However, when such a fixing apparatus is used, a temperature of an area above the fixing apparatus is naturally increased, with the result that the toner contained within the rotary developing apparatus disposed in such an area (particularly, developing device positioned in the vicinity of the fixing apparatus) may be softened. Such a condition may easily occur when the rotary developing apparatus is stopped with particular developing device facing to the fixing apparatus and the fixing apparatus is in an operative condition or a stand-by condition to control temperatures of the fixing and pressure rollers to predetermined temperatures.

Normally, the toner is formed as powder including particles having diameters of about several μm to some dozen μm obtained by crushing or suspension-porimerizing resin (such as polyester or acrylic styrene) dispersing color pigment therein and is generally softened at a temperature of about 60° C. and is completely melted at a temperature of 90° C. to 100° C.

If the toner in the developing device is softened, the softened toner will be aggregated or solidified within the developing device later to make the image formation unstable, thereby worsening the image quality.

SUMMARY OF THE INVENTION

An object of the present invention is to provide an image forming apparatus in which toner contained in a developing means can be prevented from being softened, melted or solidified due to heat from a fixing means, thereby making image formation stable.

Another object of the present invention is to provide an image forming apparatus comprising an image bearing member for bearing an electrostatic image, a developing means for containing toner and developing the electrostatic image on the image bearing member to form a toner image, and a fixing means having a heat generating source therein for heating the toner image formed on a recording material to fix the toner image to the recording material, and the developing means is disposed above the fixing means and is shifted away from the fixing means when the image is not formed on the recording material.

A further object of the present invention is to provide an image forming apparatus comprising an image bearing member for bearing an electrostatic image, a developing means for containing toner and developing the electrostatic image on the image bearing member to form toner image and having a shiftable first developing means and a second developing means different from the first developing means, a fixing means having a heat generating source therein and for heating the toner image formed on a recording material to fix the toner image to the recording material, a first image forming mode in which image formation is effected by the first developing means to form the image on the recording material, and a second image forming mode in which image formation is not effected by the first developing means but is effected by the second developing means to form the image on the recording material, and the first developing means is disposed above the fixing means and is shifted away from the fixing means in the second image forming mode.

The other objects and features of the present invention will be apparent from the following detailed explanation referring to the accompanying drawings.

DESCRIPTION OF THE PREFERRED EMBODIMENTS

The present invention will now be explained in connection with embodiments thereof with reference to the accompanying drawings.

(First Embodiment)

First of all, an image forming apparatus according to a first embodiment of the present invention will be described with reference to FIG. 1.

Figure 1:
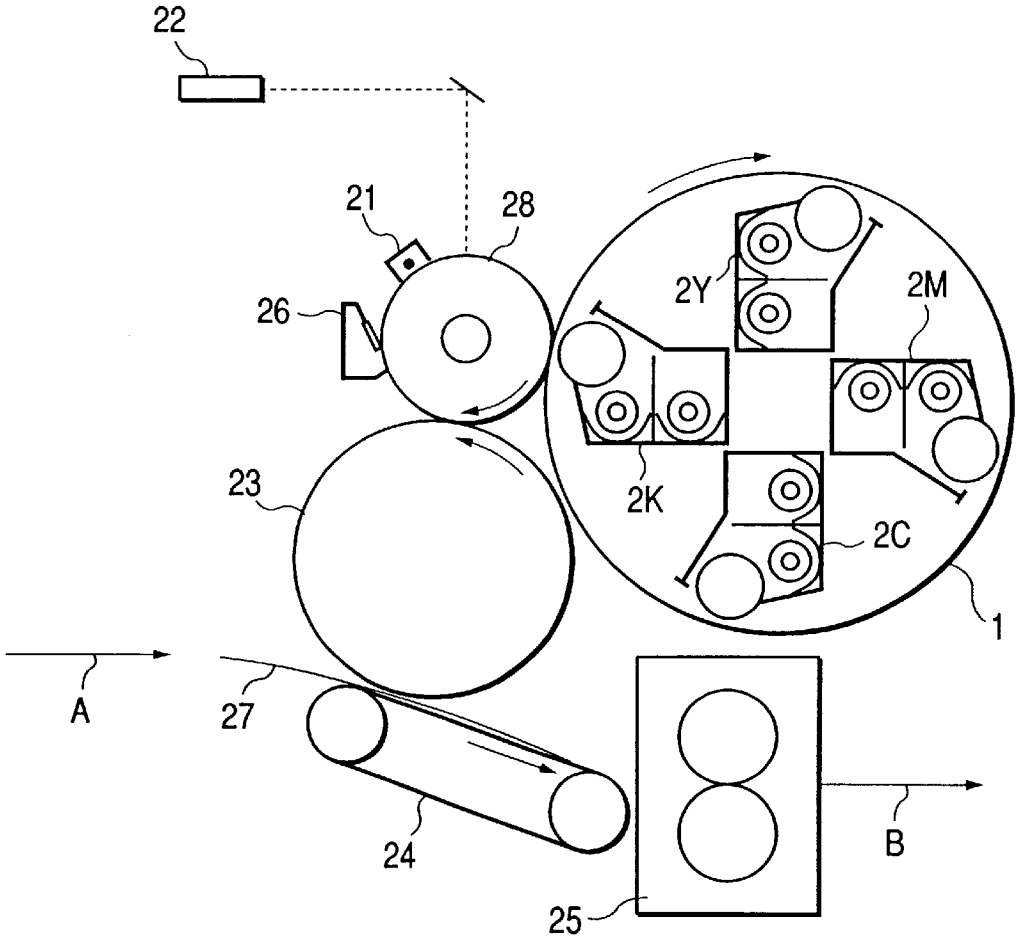
FIG. 1 is a schematic side sectional view of a color image forming apparatus according to a first embodiment of the present invention.

FIG. 1 is a schematic side sectional view of a color image forming apparatus. In FIG. 1, in the vicinity of a rotatable cylindrical image bearing member 28 having an axis extending in a direction perpendicular to the plane of FIG. 1, there are disposed a developing apparatus 1 and a transfer drum 23 which are in parallel with each other. The developing apparatus (developing unit) 1 includes developing devices (developing means) 2Y, 2M, 2C and 2K containing yellow toner, magenta toner, cyan toner and black toner, respectively, which developing devices can successively be brought to a developing station (where the developing device is opposed to the image bearing member 28) as the developing apparatus is rotated.

After a photosensitive layer on the surface of the image bearing member 28 is uniformly charged by a primary charger 21, an image signal from a laser optical system (image signal supplying means) 22 is illuminated on the charged surface to form an electrostatic image. As the image bearing member 28 is rotated, the electrostatic image reaches the developing station where the electrostatic image is opposed to the developing apparatus 1. In this case, the developing device 2K (containing the black toner) of the developing apparatus reaches the developing station, where a black toner image is formed by the black toner supplied from this developing device.

When the black toner reaches a transfer station including the transfer drum 23 as the image bearing member 28 is rotated, transfer bias is applied from the transfer drum to form an electrical field by which the black toner image is transferred from the image bearing member 28 to the transfer drum 23.

After the black toner image was transferred, residual toner remaining on the image bearing member is removed by a cleaner 26 for preparing for next image formation. Then, similar to the above, regarding a cyan color, a corresponding electrostatic image is formed, and the electrostatic image is developed by the cyan toner from the developing device 2C which has already reached the developing station to form a cyan toner image. Then, the cyan toner image is transferred onto the black toner image on the transfer drum in a superimposed fashion.

Similarly, a magenta toner image and a yellow toner image are transferred onto the transfer drum 23 in a superimposed fashion.

A convey path 24 is disposed in the vicinity of the transfer drum 23 and cooperates with the latter to a secondary transfer station therebetween. When a transfer material 27 reaches the secondary transfer station from a direction shown by the arrow A, the toner images on the transfer drum are electrostatically transferred onto the transfer material (recording material).

The transfer material bearing the toner images advances along the convey path 24 to reach a fixing apparatus 25, where the toner images are melted and mixed by heat to form a full-color image which is in turn permanently fixed to the transfer material. Thereafter, the transfer material is discharged out of the image forming apparatus.

As apparent from FIG. 1, in the image forming apparatus according to the first embodiment, the developing apparatus 1 is disposed above the fixing apparatus (fixing means).

In the present invention, in consideration of the above-mentioned softening and melting temperatures of the toner and heating temperatures of the fixing and pressure rollers of the fixing apparatus, the developing apparatus is periodically rotated to shift the developing device located near the fixing apparatus away from the fixing apparatus so that a particular part of the rotary developing apparatus (i.e., particular developing device) is not located in the vicinity of the fixing apparatus for a long term. An operating sequence for achieving such periodical rotation in the image forming apparatus shown in FIG. 1 will now be described with reference to a block diagram shown in FIG. 2.

Figure 2:
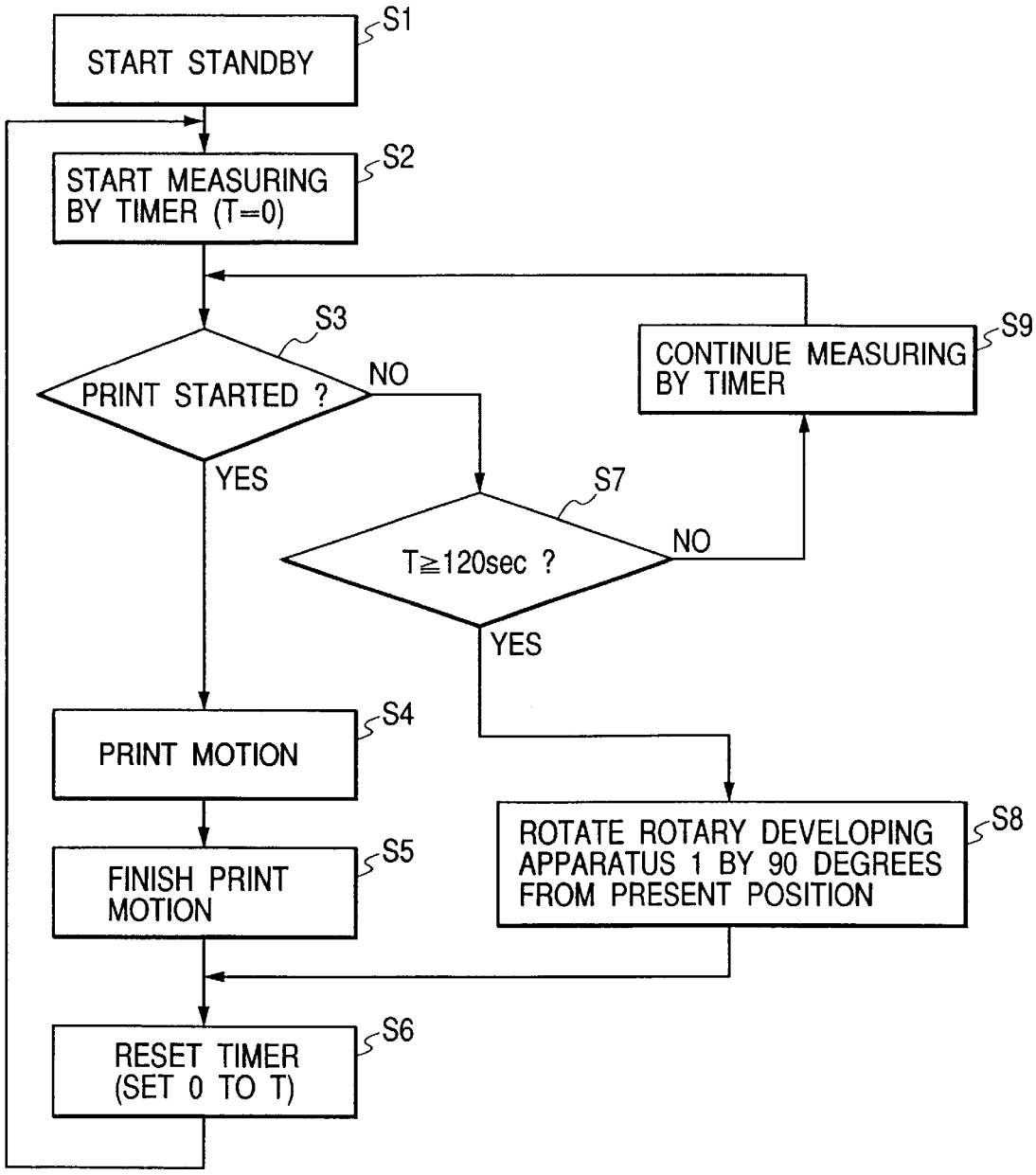
FIG. 2 is a block diagram for explaining the first embodiment of the present invention.

In FIG. 2, after a power source is turned ON, when the temperatures of the fixing and pressure rollers of the fixing apparatus 25 reach predetermined temperatures, a main body of the image forming apparatus becomes a printable condition to start stand-by (S1).

In this case, a timer included in a CPU (not shown) starts to measure an elapsed time period T (sec) from the stand-by condition (S2).

Thereafter, when the CPU receives print start instruction (S3-Y), a copying motion (print motion) is effected (S4). When the print motion is finished (S5), the timer is reset to zero (T=0) (S6) and then the program returns to S2 to continue the measurement of the timer.

In S3, if there is no print start instruction, i.e., if the image is not formed on the transfer material (S3-N; if N in S3), it is judged whether T (timer value) exceeds 120 sec (S7). If not exceed (S9), the measurement is continued.

If T exceeds 120 sec (S7-Y; if Y in S7), on the basis of instruction from the CPU, a drive motor for the developing apparatus is driven to rotate the developing apparatus by 90 degrees to retard the developing device (which was opposed to the fixing apparatus) away from the fixing apparatus (S8).

Thereafter, the program goes to S6 to reset the timer (T=0) and then the program returns to S2 to re-start the measurement of the timer.

As mentioned above, with the arrangement in which the particular part of the rotary developing apparatus is not retained in the vicinity of the fixing apparatus for 2 minutes (120 sec) or more during the stand-by condition of the image forming apparatus, the toner in the developing devices of the developing apparatus are prevented from being softened, melted or solidified due to the heat from the fixing apparatus, thereby preventing operational inconvenience without fail.

(Second Embodiment)

Next, a second embodiment of the present invention will be explained.

First of all, an image forming apparatus according to the second embodiment will be described with reference to FIG. 3.

Figure 3:
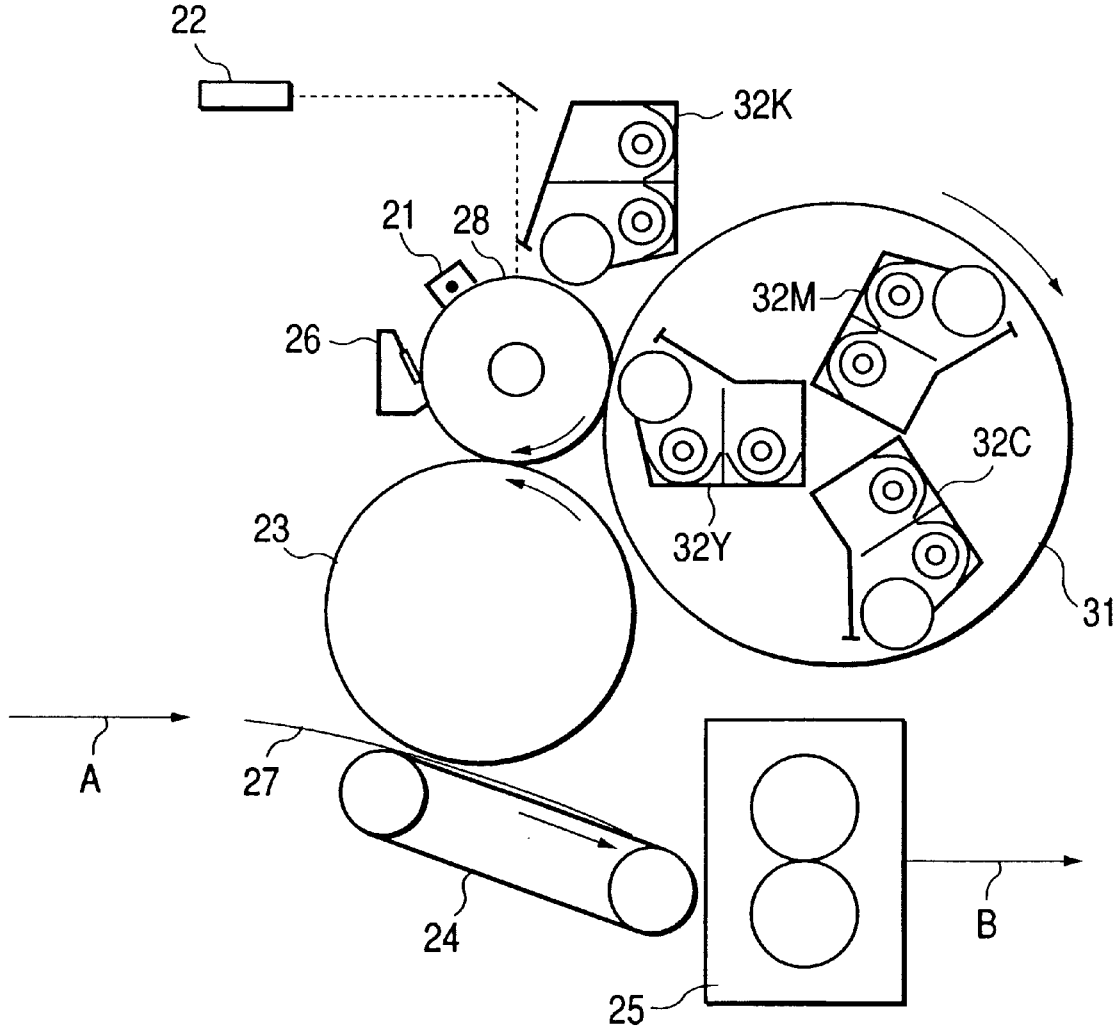
FIG. 3 is a schematic side sectional view of a color image forming apparatus according to a second embodiment of the present invention.

FIG. 3 is a schematic side sectional view of the image forming apparatus. Elements corresponding to those of the apparatus in FIG. 1 are designated by the same reference numerals and explanation thereof will be omitted. In the image forming apparatus, a developing apparatus 31 includes three developing devices (first developing means) 32Y, 32M and 32C containing yellow toner, magenta toner and cyan toner, respectively.

Further, in the image forming apparatus, a developing device (second developing means) 32K containing black toner is disposed above the developing apparatus 31 and is fixedly supported in the vicinity of the image bearing member 28. With this arrangement, a black toner containing capacity of the developing device 32K can be increased to obtain a large number of mono-color prints or copies.

As apparent from FIG. 3, the developing apparatus 31 including the first developing means is disposed above and near the fixing apparatus.

When a large number of monochromatic prints are obtained by using such an apparatus, since the yellow toner development, magenta toner development and cyan toner development are not effected, the rotation of the rotary developing apparatus 31 is not required essentially in the monochromatic image formation. However, since the fixing apparatus is used and generates heat even in the monochromatic image formation, in the second embodiment, the developing apparatus 31 is rotated to protect the toners in the developing devices.

Now, a concrete operating sequence will be described with reference to a block diagram shown in FIGS. 4, 5A and 5B.

Figure 4:
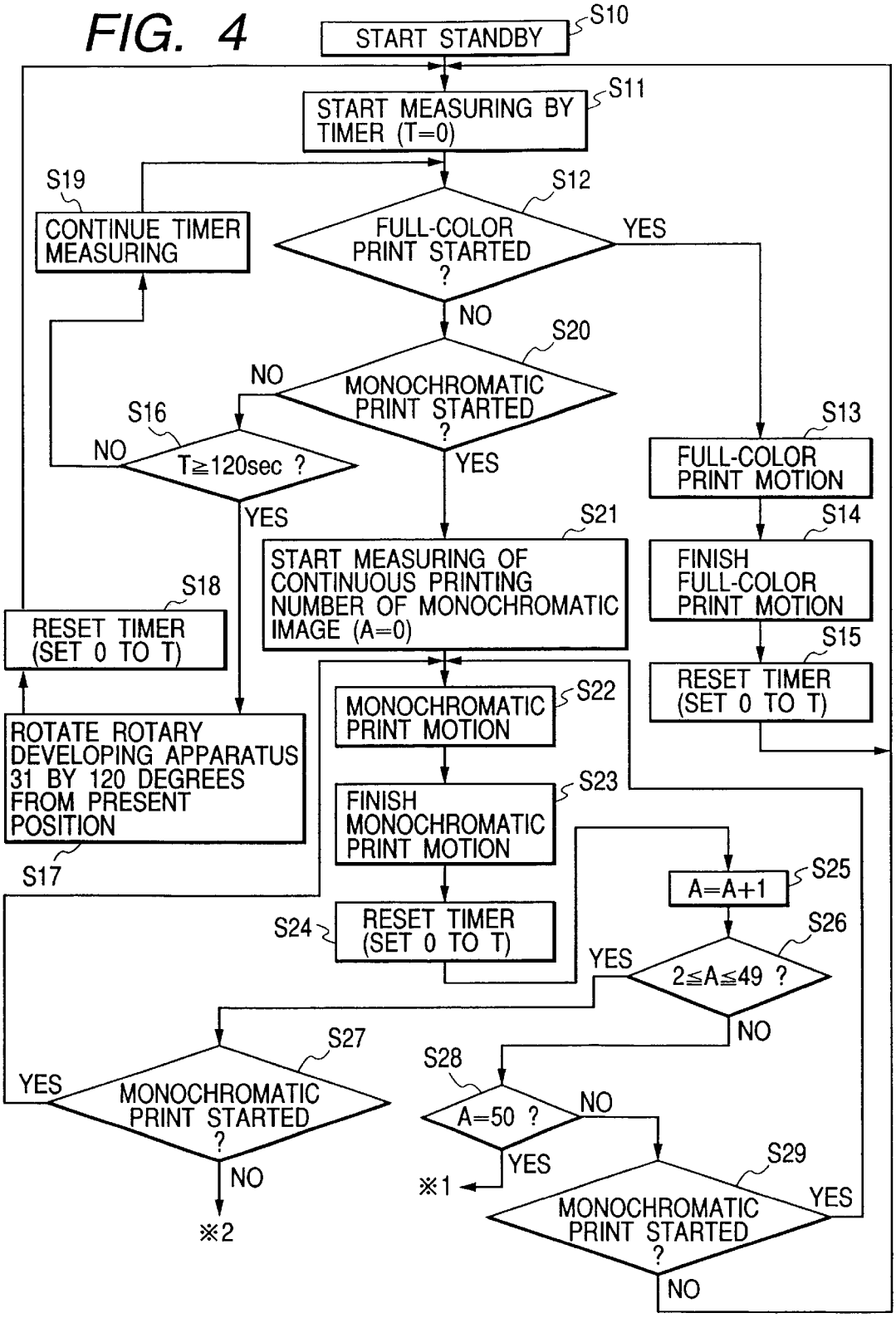
FIG. 4 is a block diagram for explaining the second embodiment of the present invention.
Figure 5A:
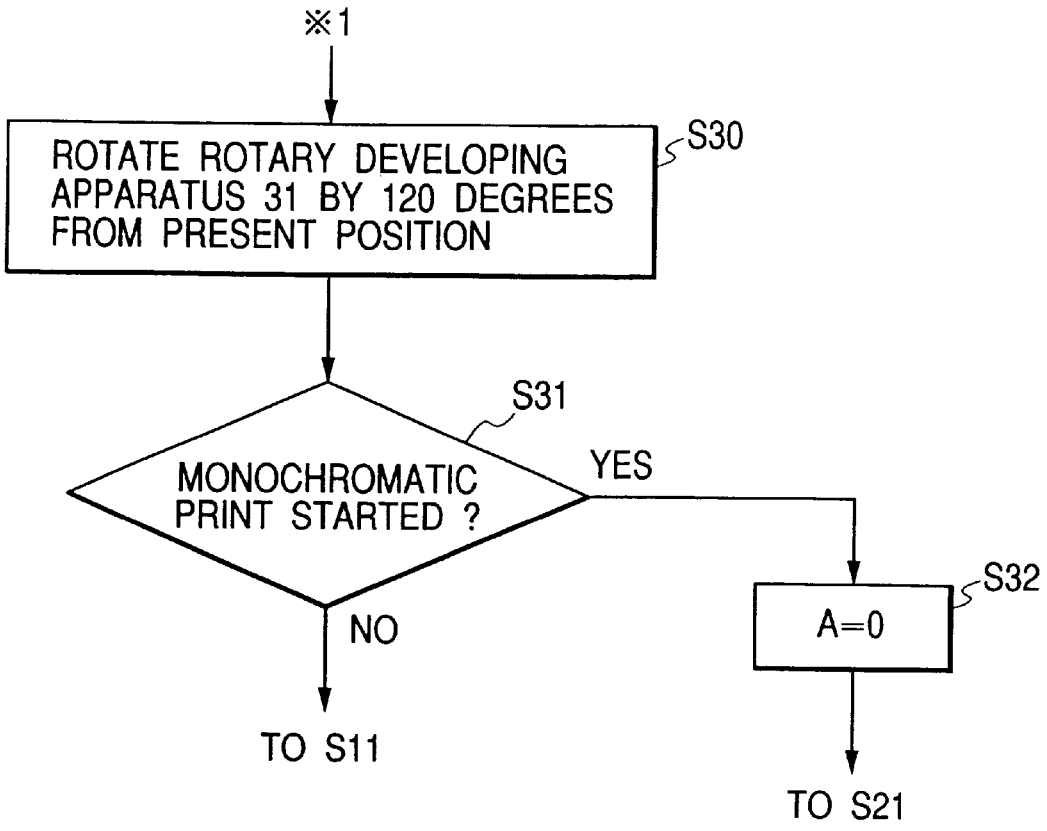
FIGS. 5A and 5B are block diagrams for explaining the second embodiment of the present invention.
Figure 5B:
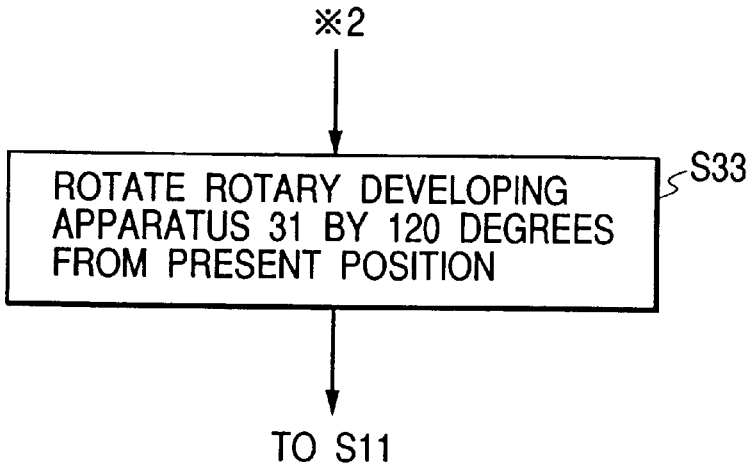
Figure 6:
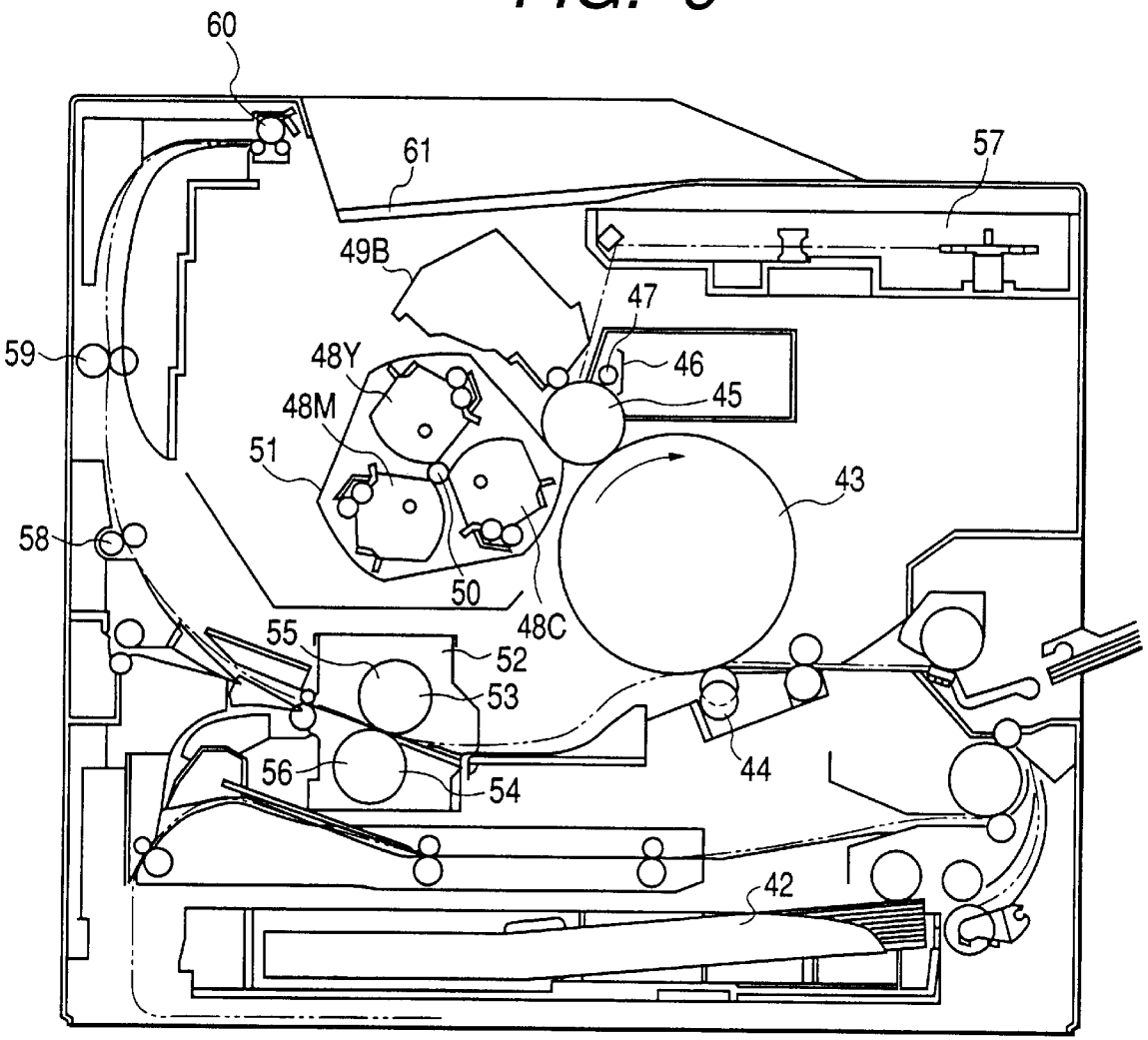
FIG. 6 is a schematic view showing a conventional image forming apparatus.

In FIG. 4, after a power source is turned ON, when the temperatures of the fixing and pressure rollers of the fixing apparatus 25 reach predetermined temperatures, a main body of the image forming apparatus becomes a printable condition to start standby (S10). In this case, a timer included in a CPU (not shown) starts to measure an elapsed time period (sec) from the stand-by condition (S11).

Thereafter, when the CPU receives full-color print (first image forming mode) start instruction to start full-color print (S12-Y), a full-color print motion is effected (S13). When the full-color print motion is finished (S14), the timer is reset to zero (T=0) (S15) and then the program returns to S11 to continue the measurement of the timer. Incidentally, during the full-color print motion (S13), the development is effected by the first and second developing means. In this case, by rotating the developing apparatus 31, the second developing means is shifted to effect respective color developments.

If the CPU does not receive the full-color print start instruction but receives monochromatic print (second image forming mode) instruction to start monochromatic image print (S12-N, S20-Y), measuring of continuous printing number of monochromatic image is started (S21).

Thereafter, a monochromatic print motion is effected (S22). When the monochromatic print motion is finished (S23), the timer is reset to zero (T=0) (S24) and "1" is added to the measured value A of the continuous printing number of monochromatic image (S25).

Incidentally, during the monochromatic print motion (S22), although the development is effected by the developing device (first developing means) 32K containing the black toner, the development is not effected by the developing devices 32Y, 32M, 32C, and, thus, the developing apparatus 31 is not rotated.

Thereafter, if the monochromatic image print is continued (S26-N, S28-N, S29-Y), the program returns to S22 to start the monochromatic print motion. In the case where the monochromatic image print is continued ($A \geqq 2$), if the continuous printing number of monochromatic image is smaller than 50 (S26-Y), when the monochromatic image print is continued, the program returns to S22 to effect next monochromatic image print motion. However, if the continuous printing number of monochromatic image reaches 50 (S26-N, S28-Y), on the basis of the instruction from the CPU, a drive motor for the developing apparatus is driven to rotate the developing apparatus by 90 degrees to retard the developing device (which was opposed to the fixing apparatus) away from the fixing apparatus (S30). Thereafter, if the monochromatic image print is continued (S31), the measured value A of the continuous printing number of monochromatic image is reset to "0" (S32), and then, the program returns to S21 to re-start the measurement, and the monochromatic image print motion is started (S22). In S30, if the monochromatic image print is not effected after the developing apparatus is rotated, the program returns to S11 to re-start the measurement of the timer.

When the continuous printing number of monochromatic image is not more than 49, if further monochromatic image print is not effected (S26-Y, S27-N), the program goes to S33 to rotate the developing apparatus by 90 degrees, and then, the program returns to S11 to start the measurement of the timer.

On the other hand, in S12, if the CPU does not receive both the full-color print start instruction and the monochromatic print start instruction (S12-N and S20-N), it is judged whether the value T of the timer exceeds 120 sec (S16). If T does not exceed 120 sec, the measurement is continued (S19).

If T exceeds 120 sec (S16-Y), on the basis of instruction from the CPU, the developing apparatus is rotated by 90 degrees to retard the developing device (which was opposed to the fixing apparatus) away from the fixing apparatus (S17). Thereafter, the program goes to S18 to reset the timer (T=0) and then the program returns to S11 to re-start the measurement of the timer.

That is to say, more specifically, the developing apparatus is rotated in the following three cases:

(1) Immediately after the continuous printing number of monochromatic image reaches 50:

In this case, the developing apparatus is rotated while an interval between the image portions at a trailing end portion of the image is opposed to the developing apparatus 31 immediately after the continuous printing number of monochromatic image reaches 50, in order not to distort the toner image formed on the image bearing member 28.

(2) After the continuous black color image formation is finished:

(3) When the image forming apparatus is in the stand-by condition for a time period not less than 120 seconds:

In this case, the rotation of the developing apparatus may be effected in the same manner as the embodiment.

In the above three cases, it is designed so that, when the rotation of the developing apparatus 31 is started or finished, none of the developing devices of the developing apparatus is opposed to the image bearing member 28.

With this arrangement, when the black image is printed continuously or intermittently or during the stand-by of the image forming apparatus, the particular part of the developing apparatus can be prevented from being affected by the heat from the fixing apparatus.

(Other Embodiment)

In the above-mentioned embodiments, while an example that the image forming apparatus has the full-color mode for forming the image by using four color toners was explained, the present invention can be applied to any image forming apparatus having two-color image print mode or three-color image print mode, as well as the image forming apparatus having the above-mentioned two modes.

As mentioned above, while the present invention was explained with respect to the above-mentioned embodiments, the present invention is not limited to such embodiment, but, various alterations and modifications can be made within the scope of the invention.

As mentioned above, according to the present invention, in the image forming apparatus having the rotary developing apparatus including a plurality of developing devices, the particular part of the developing apparatus is prevented to be opposed to the fixing apparatus having the heat generating body for a long term to soften, melt or solidify the toner in the particular part, thereby avoiding the operational inconvenience of the image forming apparatus, and, thus, obtaining the high quality image stably.

What is claimed is:

1. An image forming apparatus comprising:

an image bearing member for bearing an electrostatic image;

a developing apparatus for containing toner and developing the electrostatic image on said image bearing member to form a toner image, said developing apparatus having a shiftable first developing device and a second developing device different from said first developing device;

a fixing apparatus for heating the toner image formed on a recording material to fix the toner image to the recording material;

a first image forming mode in which image formation is effected by said first developing device to form the image on the recording material; and a second image forming mode in which image formation is not effected by said first developing device but is effected by said second developing device to form the image on the recording material, wherein said first developing device is disposed above said fixing apparatus and is shifted away from said fixing apparatus in said second image forming mode, wherein, in said second image forming mode, said first developing device is shifted away from said fixing apparatus after the images are formed on a predetermined number of recording materials.

2. An image forming apparatus according to claim 1, wherein, after image formation in said second image forming mode is finished, said first developing device is shifted away from said fixing apparatus.

3. An image forming apparatus according to claim 1, wherein, in said first image forming mode, said first developing device is shifted from a developing position to a position nearer to said fixing apparatus than said developing position.

4. An image forming apparatus according to claim 1, wherein said first developing device is provided in a rotatable unit and is shifted away from said fixing apparatus by rotating said unit.

5. An image forming apparatus according to claim 4, wherein a plurality of said first developing devices are provided, and said plurality of first developing devices are provided in said unit.

6. An image forming apparatus according to claim 1, wherein said second developing device contains black toner, and said first developing device contains color toner.

7. An image forming apparatus according to claim 1, further comprising an intermediate transfer member to which the toner image is transferred from said image bearing member, wherein the toner image is transferred from said intermediate transfer member to the recording material.

8. An image forming apparatus comprising:

an image bearing member for bearing an electrostatic image;

a developing unit having plural developing devices for developing the electrostatic image on said image bearing member;

a single developing device provided separately from said developing unit;

transfer means for transferring a developed image on said image bearing member to a recording material;

fixing means for heat-fixing the image on the recording material; and driving means for shifting said developing unit when a developing operation by said single developing device is continued for a predetermined number of times.

9. An image forming apparatus according to claim 8, wherein said developing unit is provided nearer to said fixing means than said single developing device.

10. An image forming apparatus according to claim 8, wherein said developing unit is provided substantially above said fixing means.

11. An image forming apparatus according to claim 8, wherein said single developing device contains a black developer.

12. An image forming apparatus according to claim 8, wherein said driving means drives said developing unit so that a developing device adjacent to said single developing device to which said image bearing member is opposed is opposed to said image bearing member.

13. An image forming apparatus comprising:

image forming means for forming an image on a recording material;

said image forming means including an image bearing member for bearing an electrostatic image, a developing unit having plural developing devices for developing the electrostatic image on said image bearing member, and a single developing device provided separately from said developing unit, fixing means for heat-fixing the image on the recording material; and driving means for shifting said developing unit when a developing operation by said single developing device is continued for a predetermined number of times.

14. An image forming apparatus according to claim 13, wherein said image forming means includes an intermediate transfer body on which the image is transferred from said image bearing member, and transfer means for transferring the image from said intermediate transfer body to the recording material.

15. An image forming apparatus according to claim 13, wherein said developing unit is provided nearer to said fixing means than said single developing device.

16. An image forming apparatus according to claim 13, wherein said developing unit is provided substantially above said fixing means.

17. An image forming apparatus according to claim 13, wherein said single developing device contains a black developer.

18. An image forming apparatus according to claim 13, wherein said driving means drives said developing unit so that an adjacent developing device is opposed to said image bearing member.

* * * * *